US009332797B2

(12) United States Patent
Abers

(10) Patent No.: US 9,332,797 B2
(45) Date of Patent: May 10, 2016

(54) FULL-BRIMMED HAT CAPABLE OF ACCOMMODATING A HEADSET

(71) Applicant: Daniel Jesse Abers, Reno, NV (US)

(72) Inventor: Daniel Jesse Abers, Reno, NV (US)

( * ) Notice: Subject to any disclaimer, the term of this patent is extended or adjusted under 35 U.S.C. 154(b) by 304 days.

(21) Appl. No.: 13/971,700

(22) Filed: Aug. 20, 2013

(65) Prior Publication Data

US 2014/0047617 A1 Feb. 20, 2014

Related U.S. Application Data

(60) Provisional application No. 61/684,922, filed on Aug. 20, 2012.

(51) Int. Cl.
*A42B 1/24* (2006.01)
*A42B 1/00* (2006.01)

(52) U.S. Cl.
CPC ..... *A42B 1/245* (2013.01); *A42B 1/002* (2013.01)

(58) Field of Classification Search
CPC ..... A42B 1/002; A42B 1/06; A42B 1/20; A42B 1/201; A42B 1/245; A42B 1/24
USPC ..... 2/175.1, 175.2, 175.5, 195.7, 209.13; 381/388, 376
See application file for complete search history.

(56) References Cited

U.S. PATENT DOCUMENTS 742,731 A * 10/1903 Plato ..... A42B 1/201 2/175.5
945,268 A * 1/1910 Dodd ..... A42B 1/02 2/175.1
2,105,002 A * 1/1938 Miller ..... A42B 1/201 2/175.1
3,908,199 A * 9/1975 Lim ..... A42B 1/004 2/175.1
4,833,726 A * 5/1989 Shinoda ..... A42B 3/30 381/376
4,858,248 A * 8/1989 Goldsmith ..... A42B 1/245 2/172
5,504,943 A * 4/1996 Han ..... G10K 5/00 2/195.1
5,802,616 A * 9/1998 Watson ..... A42B 1/02 2/175.1
5,881,160 A * 3/1999 Sheppard ..... H04R 5/023 381/374
6,202,219 B1 * 3/2001 Cheever ..... A42B 1/22 2/175.1
6,484,323 B1 * 11/2002 Pu ..... A42B 1/201 2/10
6,546,264 B1 * 4/2003 Kennedy ..... A42B 3/30 379/430
D637,378 S * 5/2011 Cornwell ..... D2/887
7,974,432 B1 * 7/2011 Ryan ..... A42B 1/245 2/195.1
8,526,658 B1 * 9/2013 Houston ..... H04R 5/0335 381/301
8,627,515 B1 * 1/2014 Scott ..... A42B 1/201 2/175.1

(Continued)

*Primary Examiner* — Khaled Annis

(57) ABSTRACT

A system for a full-brimmed hat capable of accommodating a headset includes a full-brimmed hat and a headset. The full-brimmed hat allows users to simultaneously wear the headset and obtain full protection from harmful sun rays while also providing shielding from the sunlight. The full-brim is designed with brim joints which are adjusted by fasteners. The brim joints open the holes on the sides of the full-brimmed hat, and the earpieces of the headset are placed in the holes. The frame of the headset rests on top of the full-brimmed hat, which accommodates both a large headset and a small headset.

13 Claims, 12 Drawing Sheets

(56) References Cited

U.S. PATENT DOCUMENTS 9,071,903 B1* 6/2015 Crockran, Jr. ..... H04R 1/1008
2002/0131616 A1* 9/2002 Bronnikov ..... A42B 1/245 381/370
2004/0180691 A1* 9/2004 Cascone ..... A42B 1/245 455/557
2004/0204207 A1* 10/2004 Parker ..... A42B 1/245 455/575.2
2004/0244096 A1* 12/2004 Claro ..... A42B 1/22 2/195.2
2008/0209615 A1* 9/2008 Raftery ..... A42B 1/24 2/209.13
2008/0295224 A1* 12/2008 Mintzer ..... A42B 1/245 2/209.13
2009/0151047 A1* 6/2009 Garza ..... A42B 1/225 2/174
2009/0208040 A1* 8/2009 Planansky ..... H04R 5/02 381/301
2009/0257615 A1* 10/2009 Bayer, Jr. ..... H04R 1/1066 381/376
2010/0132092 A1* 6/2010 Temblador ..... A42B 1/008 2/182.8
2011/0000941 A1* 1/2011 Volk ..... A42B 1/241 224/181
2011/0116673 A1* 5/2011 Lewis ..... A42B 1/245 381/376
2011/0191941 A1* 8/2011 Chiang ..... A42B 1/245 2/209.13

* cited by examiner

FULL-BRIMMED HAT CAPABLE OF ACCOMMODATING A HEADSET

The current application claims a priority to the U.S. Provisional Patent application Ser. No. 61/684,922 filed on Aug. 20, 2012.

FIELD OF THE INVENTION

The present invention relates generally to a fully-brimmed hat that may be worn while wearing a headset or headphones. More particularly, its objective is to provide the user full protection from harmful sun rays while allowing the user to wear the headset or headphones as well as improving the visibility of the wearer by shielding the sun from the eyes.

BACKGROUND OF THE INVENTION

It is not practically possible to comfortably wear both a headset and a full-brimmed hat. A Headset offers the user the ability to block out background noise thus dramatically increasing the quality of the listening experience, and a full-brimmed hat provides the user with the greatest protection from harmful and distracting sunlight. It is impractical and nearly impossible to wear a headset over a full-brimmed hat without a great deal of sacrifice to comfort and protection from the sun. Additionally, it is very uncomfortable to wear a headset under the hat as well. People often resort to using in-ear earphones or earbuds in order to be able to wear both earphones and a full-brimmed hat. However, for people in occupations such as pilots and airport ground personnel who often are required to wear a headset or headphones, it is not possible to wear a headset with a full-brimmed hat. Additionally people who recreationally spend a great deal of time outdoors require protection from the sun and quite often wish to listen to music. Because of the issues detailed above, these people are often unable to achieve both protection from the sun and musical entertainment without sacrifice to either. The present invention seeks to address the issues faced by people who are required or desire to comfortably wear a headset while also experiencing the protection of a full-brimmed hat.

It is therefore an object of the present invention to provide a practical means or system for people to wear a headset with large earpiece while also wearing a full-brimmed hat. The present invention accomplishes this by means of holes located on the sides of the brimmed hat through which the frame or earpieces of the headset can be placed. This allows the headset to be worn normally and rest on top of the user's head and the top of the hat. It is only possible to insert the earpieces of the headset through the opening by means of brim joints that are located on the outer edges of the openings. The brim joints may be opened or closed by the user and may also be adjusted before use or during use in order to accommodate the headset and adjust comfort. Once the earpieces and the frame of the headset have been placed within the openings, the brim joints may be closed by hook and loop fasteners or by some other means of attachment. The headset is now ready to be worn comfortably with the present invention and its full brim is able to provide the user protection from the sun. The present invention certainly does have its use in a recreational setting, and it is also very useful as a safety devise. Since the present invention can be worn by airport ground support personnel, airport control tower personnel, pilots while in flight, individuals at firing range, military personnel, and landscaping crews, the safety aspects of the present invention minimize the fatiguing nature of working out in the sun and increase the visibility factor which is especially notable during sunrise and sunset. Because of these facts, the present invention increases the efficiency of their work while creating a safe work environment. The present invention is available in multiple configurations to accommodate the various shapes and sizes of headset or headphone earpieces and frames that users may wish to wear in conjunction with the present invention.

DETAILED DESCRIPTION OF THE INVENTION

All illustrations of the drawings are for the purpose of describing selected versions of the present invention and are not intended to limit the scope of the present invention.

Figure 1:
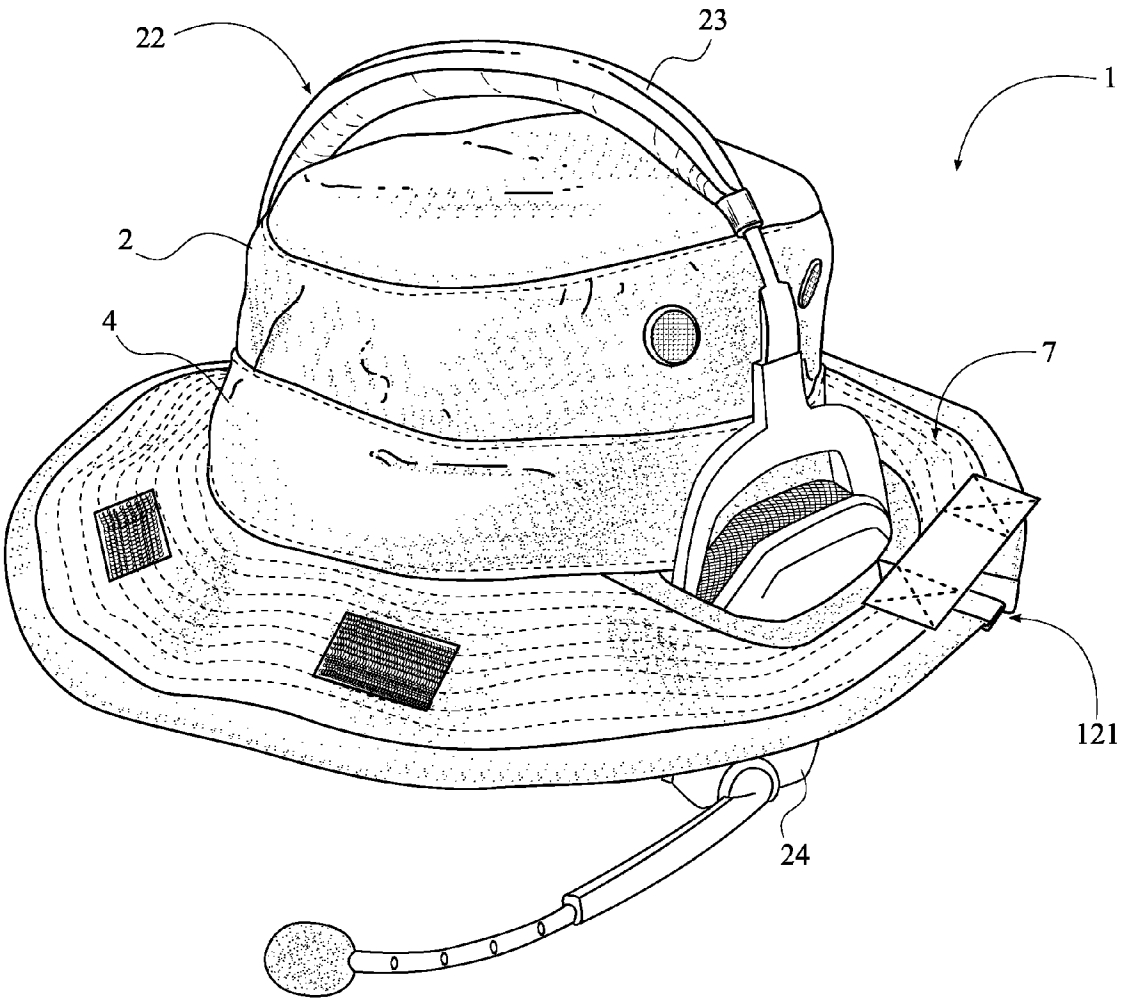
FIG. 1 is a left perspective view of a user wearing the preferred embodiment of the present invention with a headset.
Figure 2:
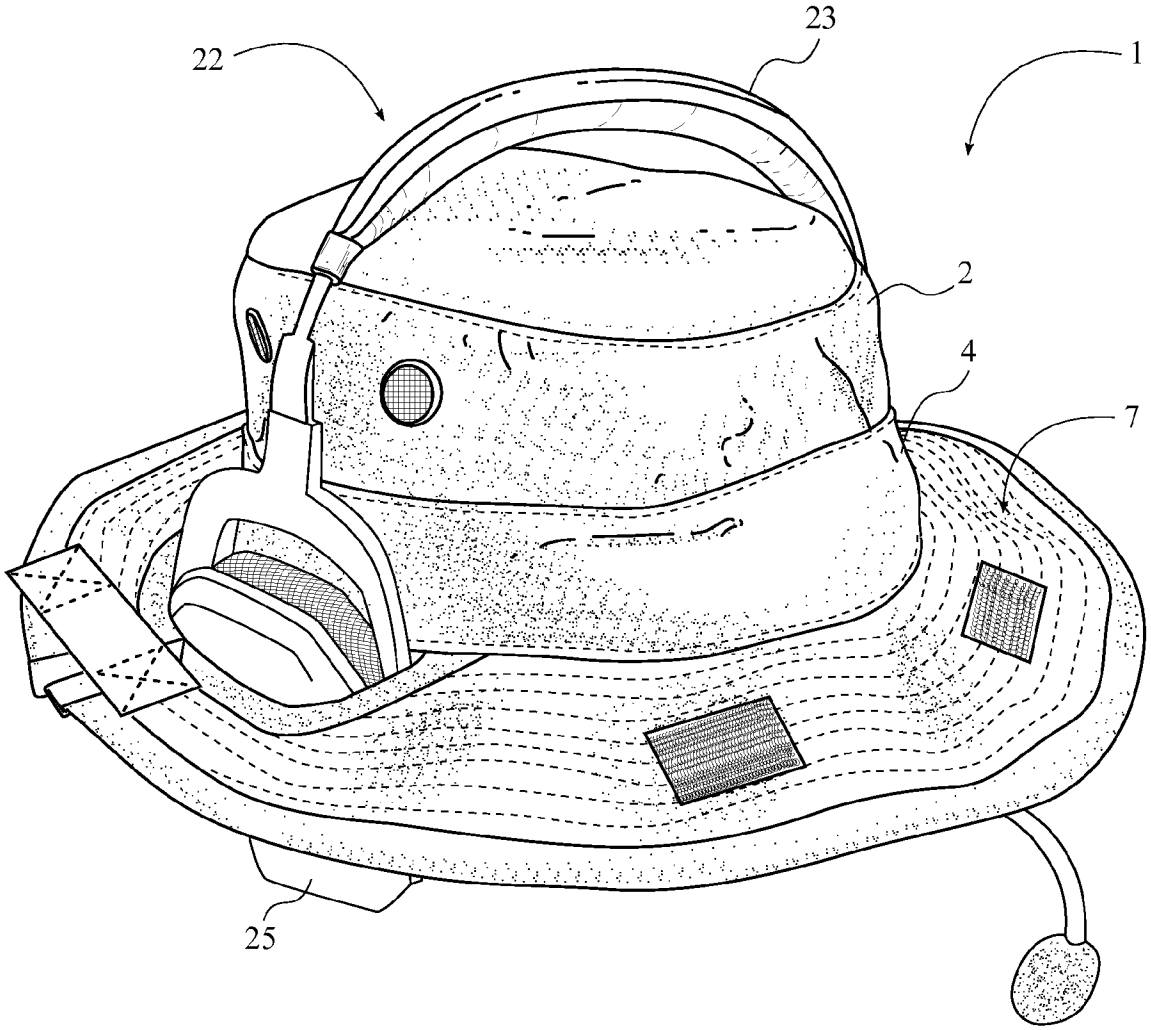
FIG. 2 is a right perspective view of a user wearing the preferred embodiment of the present invention with a headset.
Figure 3:
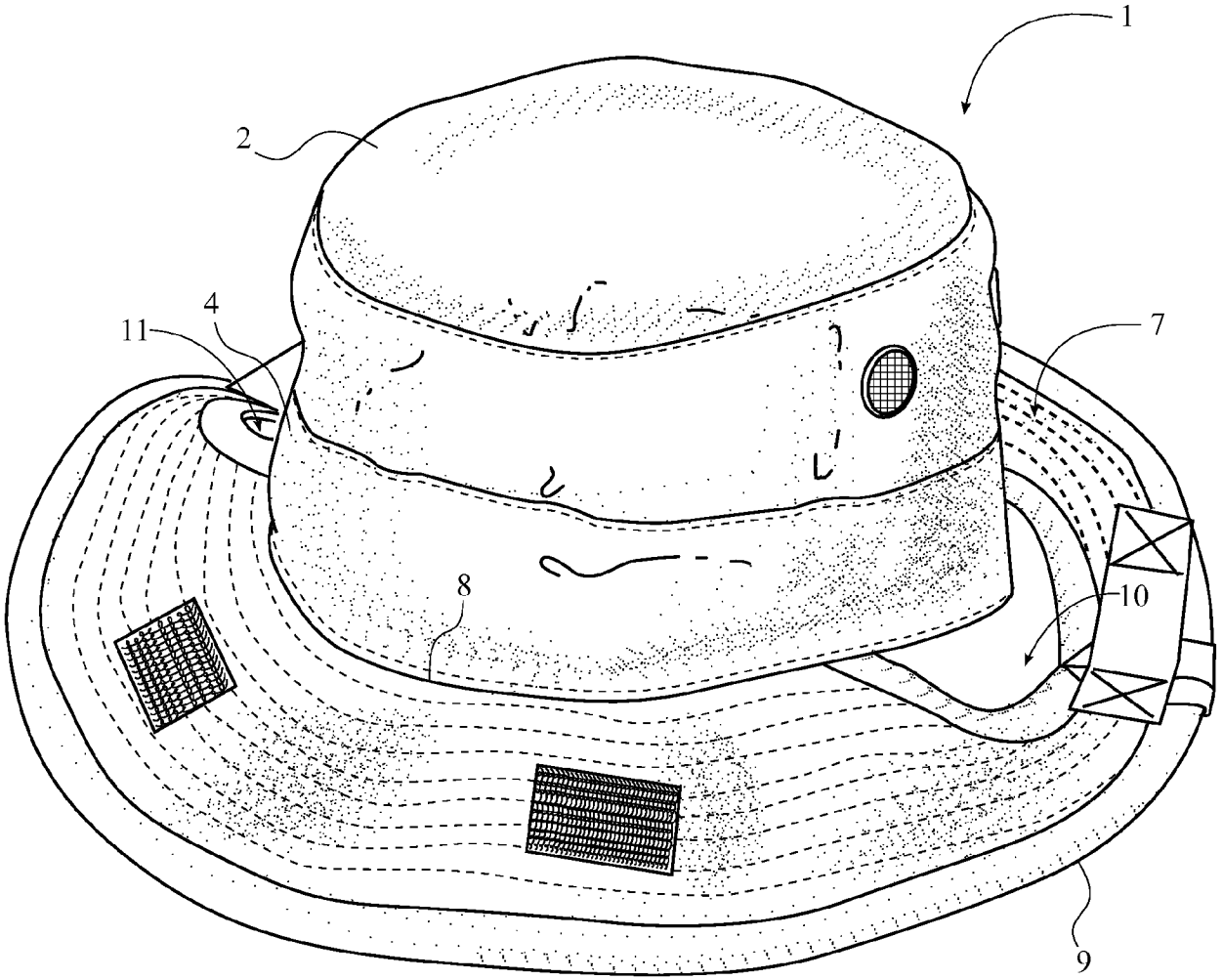
FIG. 3 is a perspective view of the present invention in its preferred embodiment.

As can be seen in FIGS. 1 and 2, the present invention is a full-brimmed hat that is designed to accommodate a full-sized headset while the hat is being worn. A system for the present invention comprises a full-brimmed hat 1 and a headset 22.

Figure 4:
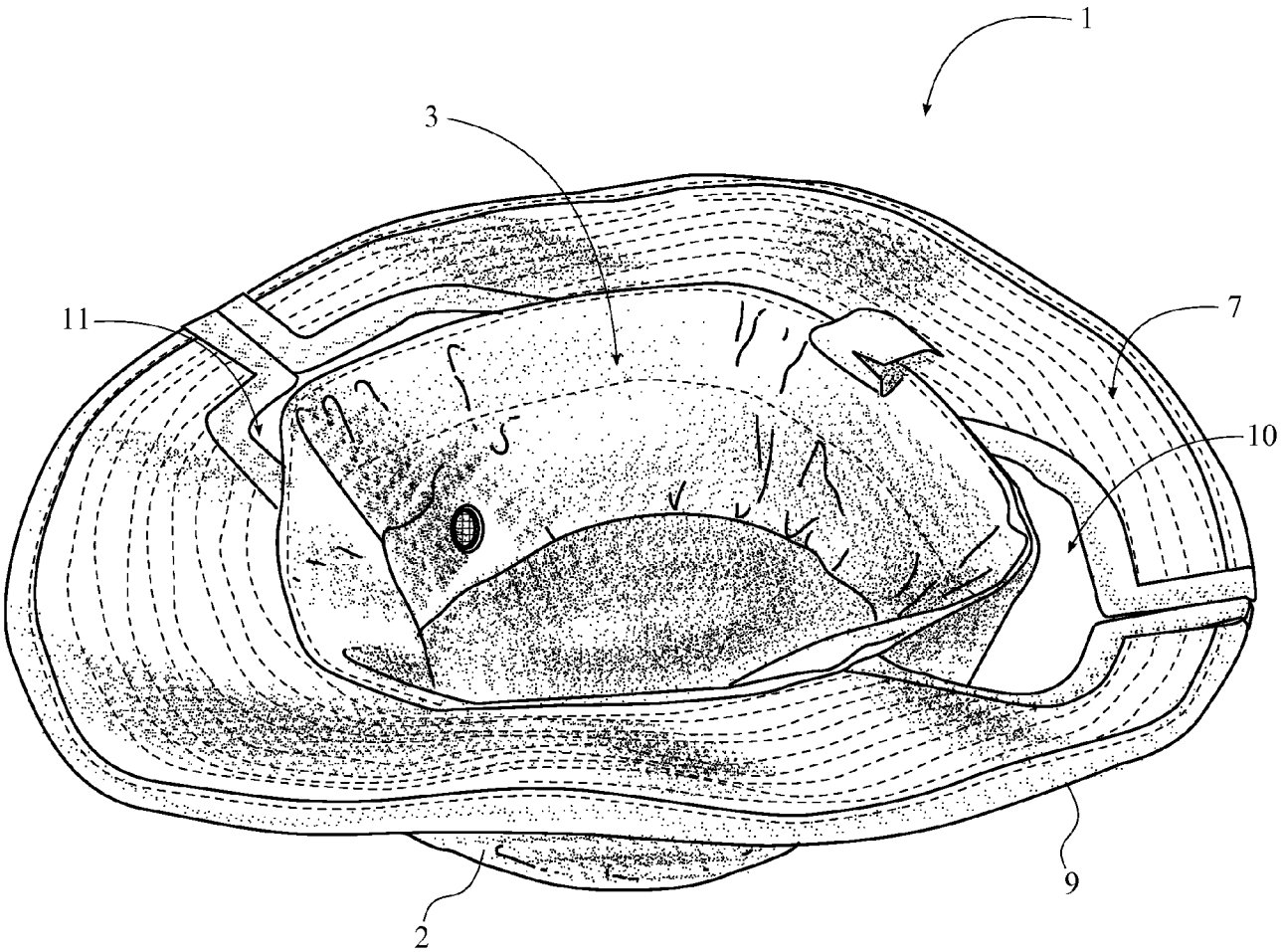
FIG. 4 is a bottom perspective view of the present invention in its preferred embodiment.

The full-brimmed hat 1 provides the user full protection from harmful sun rays and increases the visibility of the wearer by shielding sunlight from the eyes. The full-brimmed hat 1 is a boonie (or boney) style hat, a jungle hat, or a hat the military would wear. The full-brimmed hat 1 comprises a circular bucket 2, a rim 4, and a full-brim 7. The circular bucket 2 forms the top of the full-brimmed hat 1 and the user's head fits within a head insertion opening 3, which can be seen more clearly in FIG. 4. The circular bucket 2, as well as the rim 4 and the full-brim 7, are made from a light weight and breathable fabric which is also a uniform and flexible material.

In the preferred embodiment of the present invention, the full-brim 7 is circumferentially positioned around the rim 4, and is also perpendicularly connected to the rim 4. The full-brim 7 comprises an inner diameter 8, an outer diameter 9, a left headset hole 10, a right headset hole 11, a left brim joint 12, a right brim joint 17, a left hook strip 18, a right hook strip 19, a left loop strip 20, a right loop strip 21 and a right and left brim joint inner edge 12I.

Figure 5:
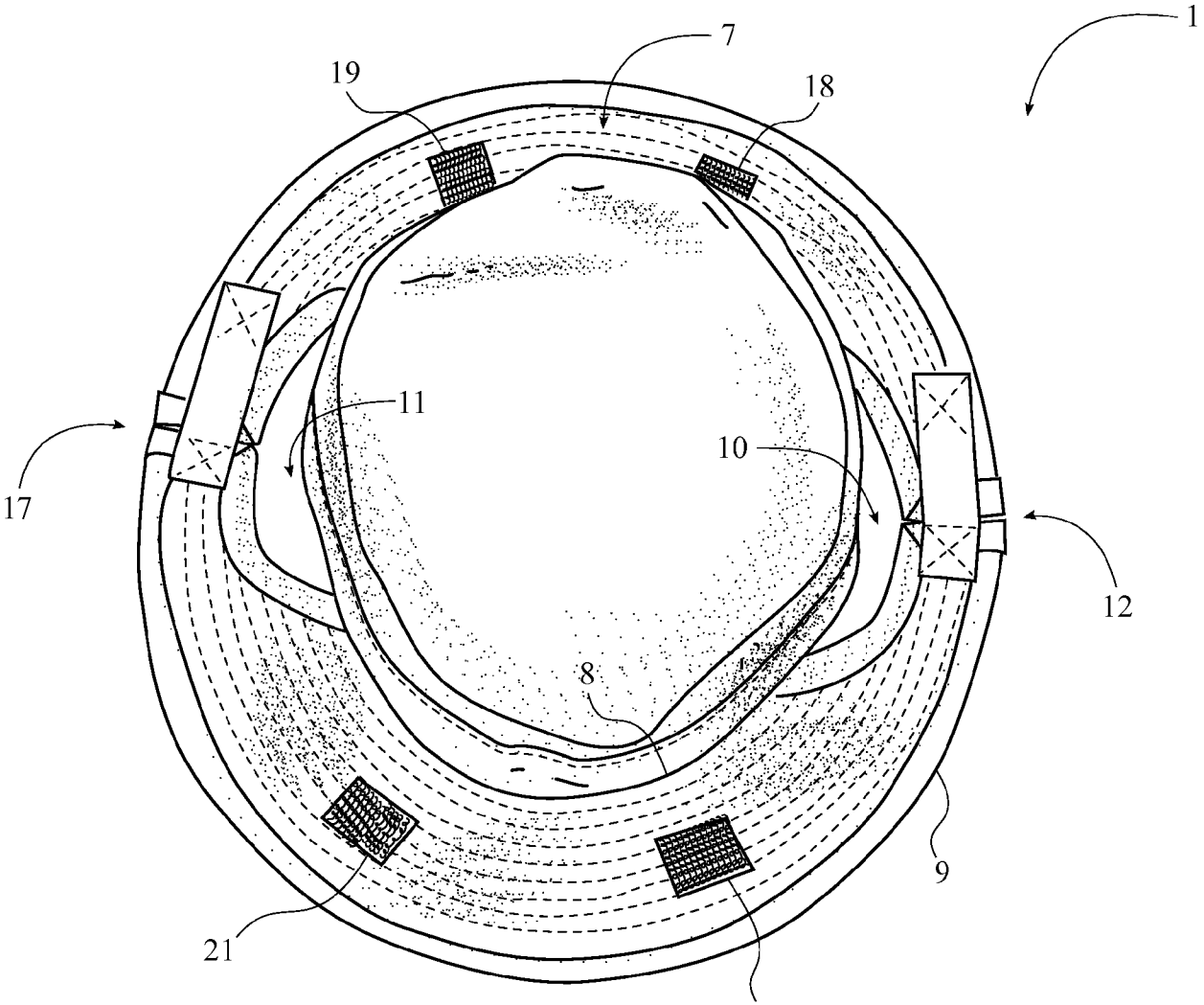
FIG. 5 is a top view of the present invention in its preferred embodiment.

The left headset hole 10 and the right headset hole 11 provide the area for the headset 22 to traverse, and can be seen more clearly in FIG. 5. The left headset hole 10 and the right headset hole 11 are diametrically opposed to each other around the full-brim 7; the left headset hole 10 and the right headset hole 11 traverse through the full-brim 7; and, the left headset hole 10 and the right headset hole 11 are adjacently positioned around the inner diameter 8. The shape of the left headset hole 10 and the right headset hole 11 is preferably a circular shape, but the shape is not limited to the circular shape and can be any other geometric or organic shapes in order to accommodate uniquely shaped headphones or any other type of headgears.

The rim 4 is circumferentially positioned around the head insertion opening 3 of the circular bucket 2, and the rim 4 is connected around the circular bucket 2. The rim 4 comprises a first stiffener 5 and a second stiffener 6. The first stiffener 5 and the second stiffener 6 are positioned within the rim 4 to provide more rigid areas in the full-brimmed hat 1. The first stiffener 5 is adjacently positioned to the left headset hole 10 and the second stiffener 6 is adjacently positioned to the right headset hole 11. The first stiffener 5 and the second stiffener 6 allow the full-brimmed hat 1 be more easily situated on the head of the wear and also prevents the fabric from the bunching up while the full-brimmed hat 1 is being placed on the wearers head as well as prevents bunching up while the full brimmed hat 1 is being used with the headset 22.

Figure 6:
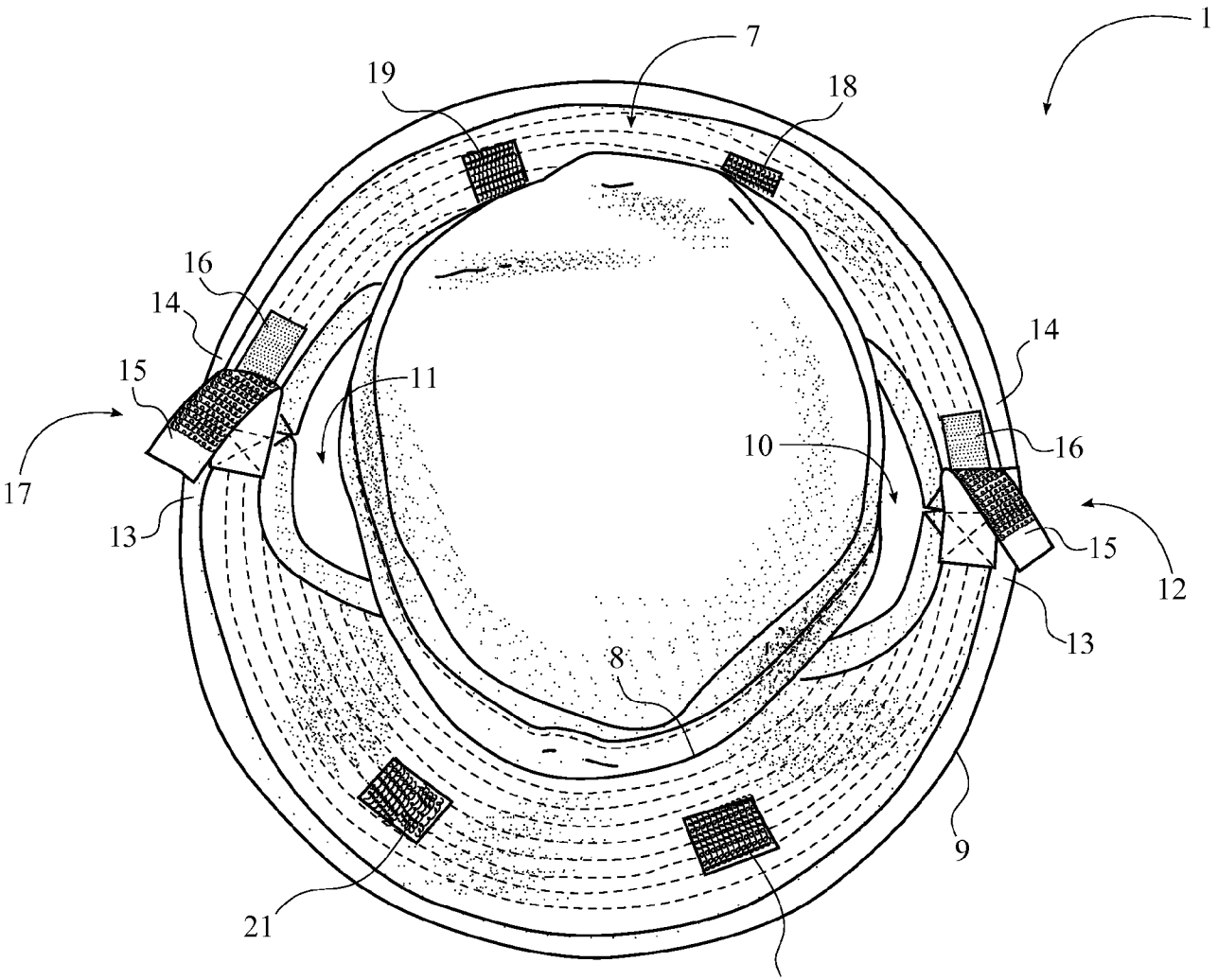
FIG. 6 is a top view of the present invention in its preferred embodiment with the left brim joint is disconnected and the right brim joint is disconnected.
Figure 7:
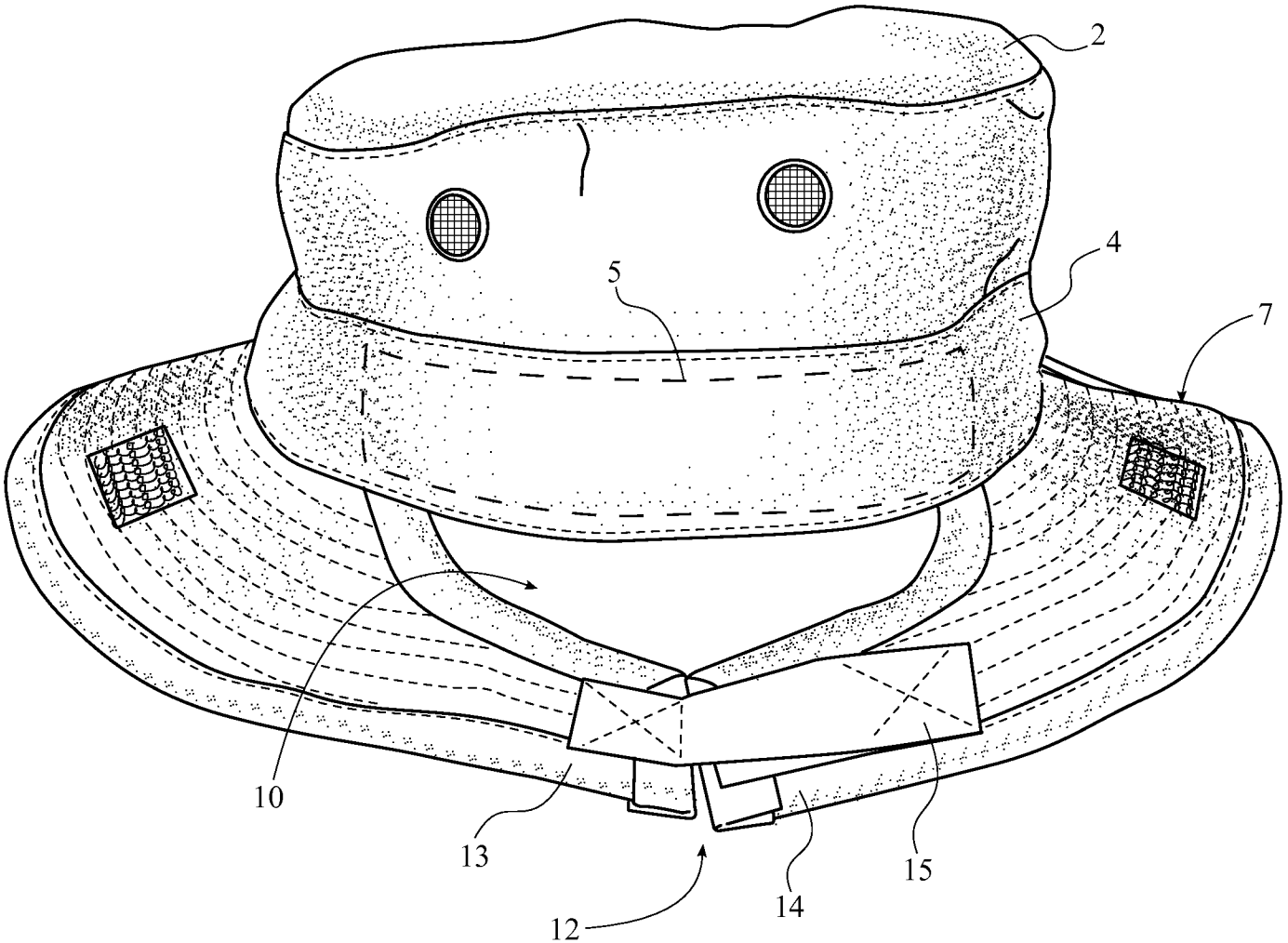
FIG. 7 is a left side view of the present invention in its preferred embodiment.
Figure 8:
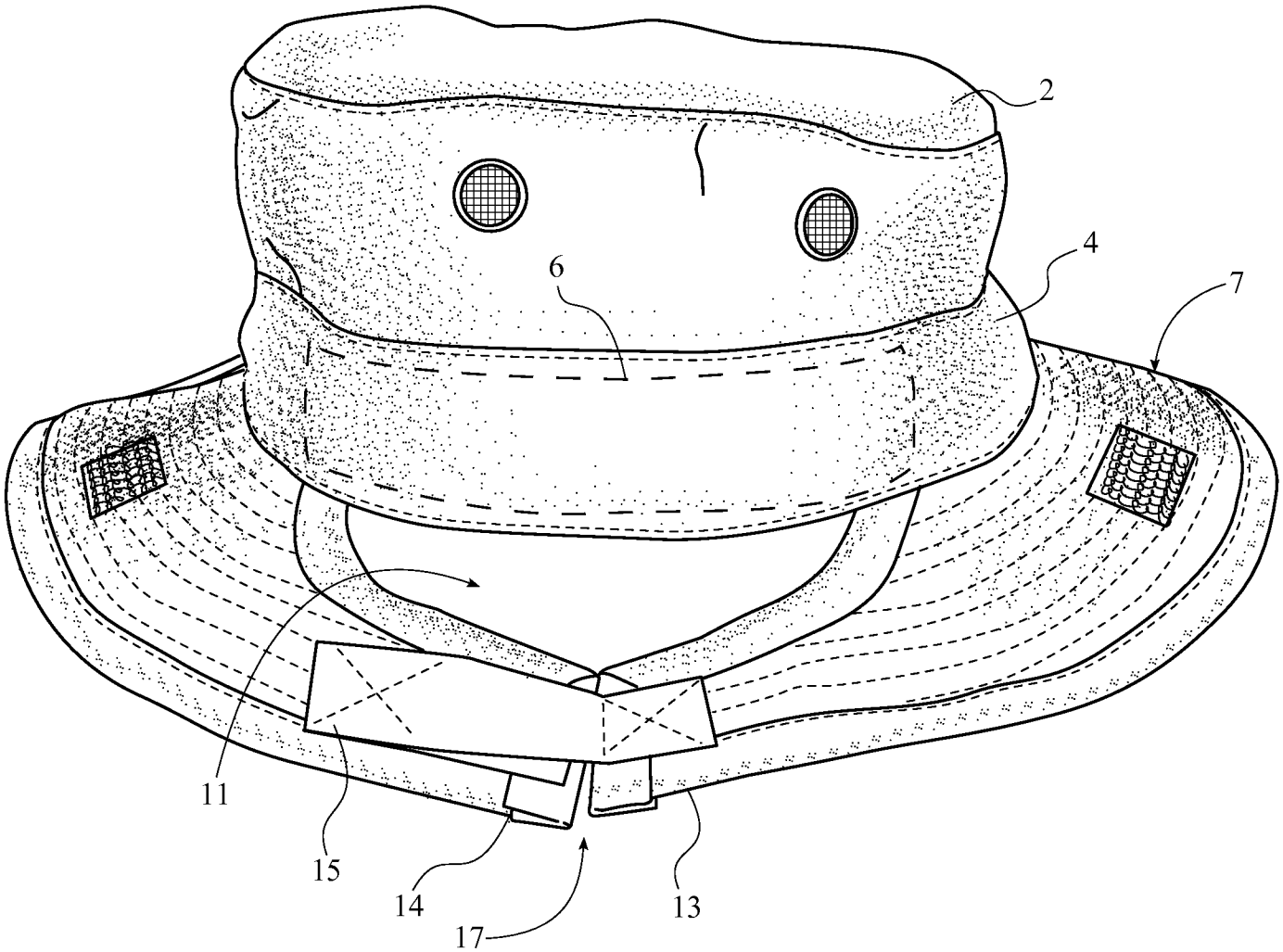
FIG. 8 is a right side view of the present invention in its preferred embodiment.

Referring back to the components of the full-brim 7, the left brim joint 12 and the right brim joint 17 each comprise a first flap 13, a second flap 14, a hook part 15, and a loop part 16, which are shown in FIG. 6. The left brim joint 12 and the right brim joint 17 allow the user to respectively open the left headset hole 10 and the right headset hole 11. The left brim joint 12 is positioned between the left headset hole 10 and the outer diameter 9. The hook part 15 is adjacently connected to the first flap 13 and the loop part 16 is adjacently connected to the second flap 14. The first flap 13 is attached to the second flap 14 through the hook part 15 and the loop part 16. The right brim joint 17 is positioned between the right headset hole 11 and the outer diameter 9. The hook part 15 is adjacently connected to the first flap 13 and the loop part 16 is adjacently connected to the second flap 14. The first flap 13 is attached to the second flap 14 through the hook part 15 and the loop part 16. In the preferred embodiment, the left brim joint 12 and the right brim joint 17 respectively opens adjacent with the center of the left headset hole 10 and the right headset hole 11 wherein the right and left brim joint is a slit extending between the brim joint inner edge and the full-brim outer diameter allowing two brim ends along the slit to be separable and attachable via the first and second flaps.

In the preferred embodiment of the present invention, the left hook strip 18, the right hook strip 19, the left loop strip 20, and the right loop strip 21 are radially positioned around the full-brim 7, as can be seen in FIG. 5 and FIG. 6. The left hook strip 18 is adjacently positioned with the second flap 14 of the left brim joint 12; the right hook strip 19 is adjacently positioned with the second flap 14 of the right brim joint 17; the left loop strip 20 is adjacently positioned with the first flap 13 of the left brim joint 12; and, the right loop strip 21 is adjacently positioned with the first flap 13 of the right brim joint 17.

Figure 9:
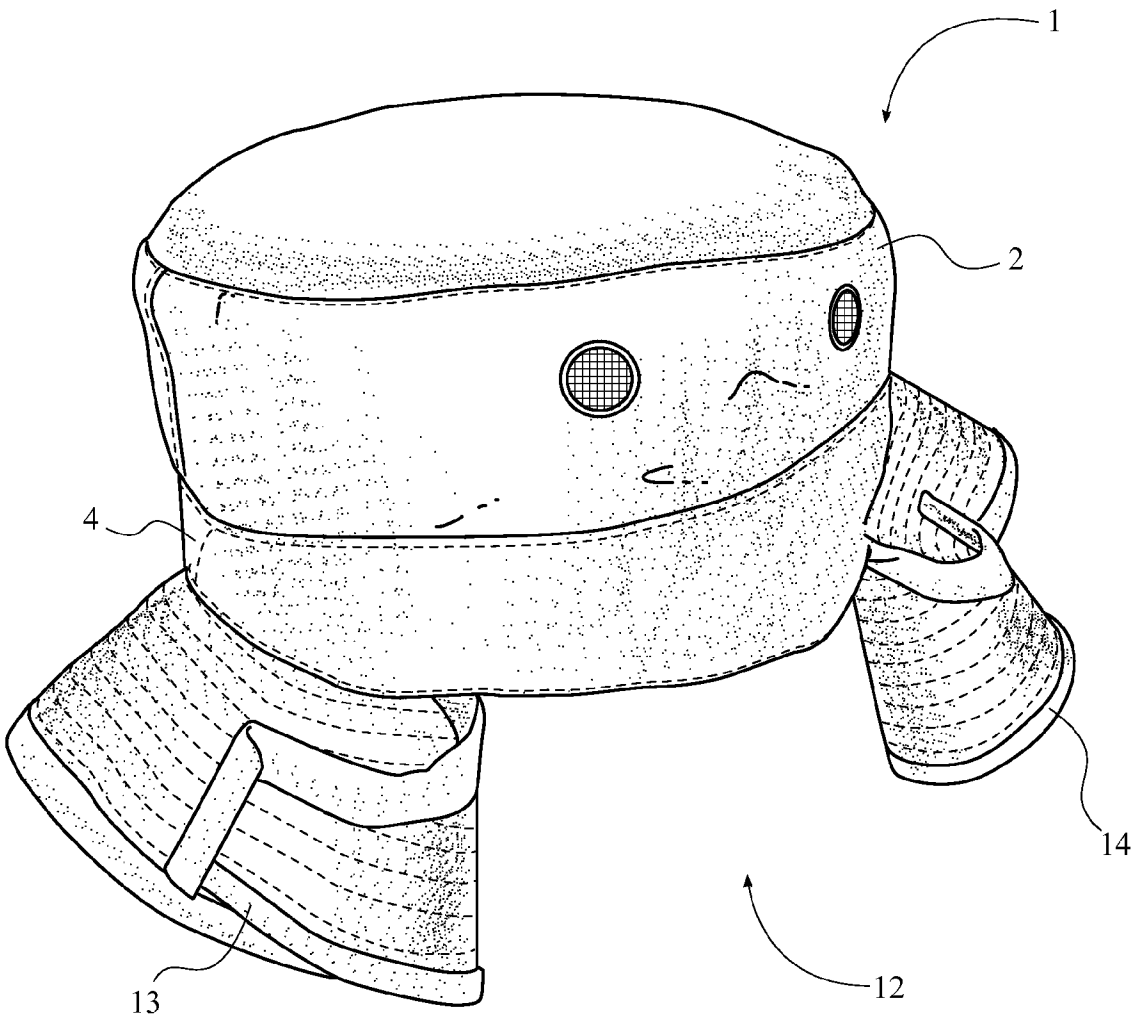
FIG. 9 is a perspective view of the present invention in its preferred embodiment with open brim joints.
Figure 10:
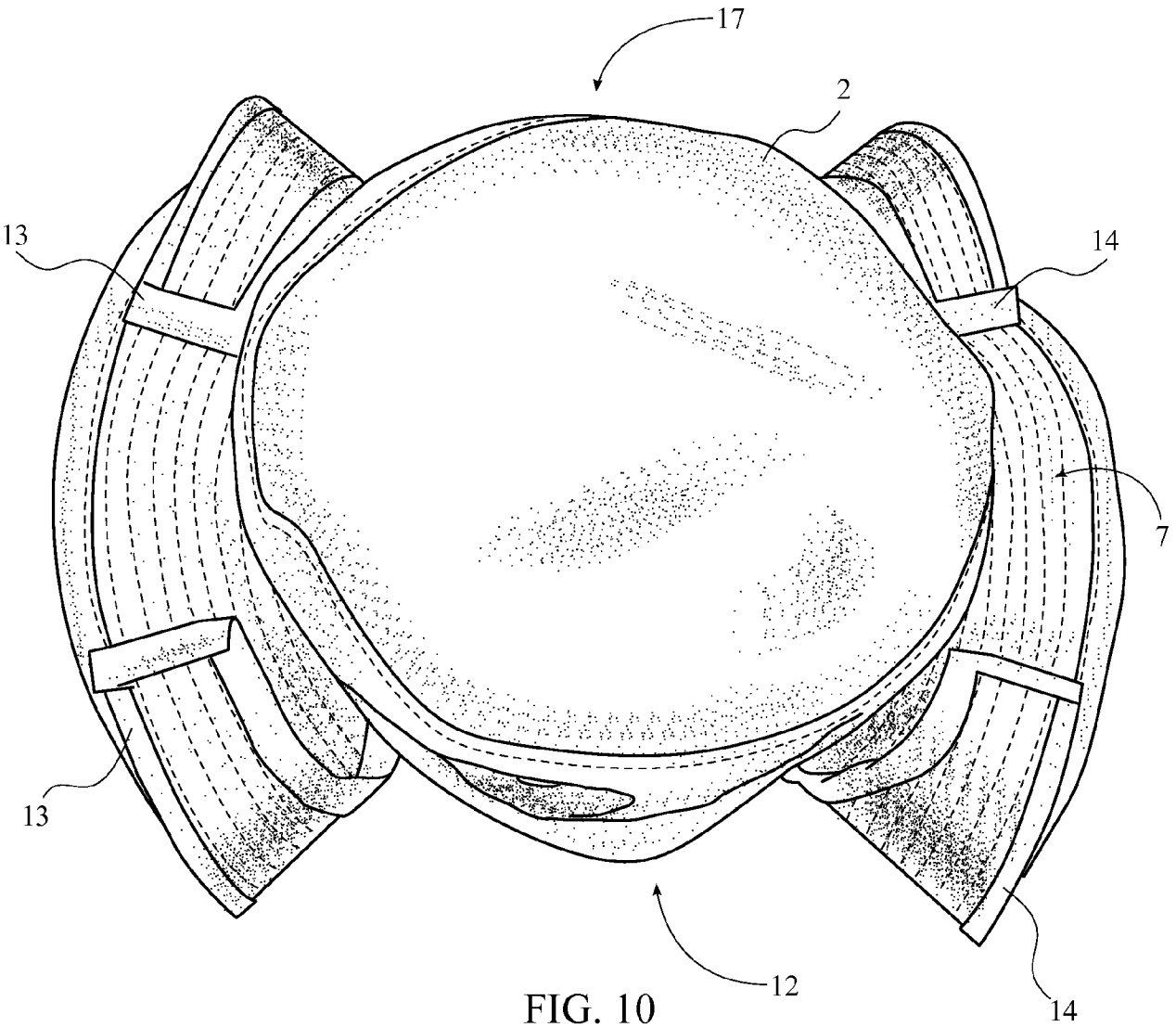
FIG. 10 is a top view of the present invention in its preferred embodiment with open brim joints.

When ready to wear both the full-brimmed hat 1 and the headset 22, the user opens the left brim joint 12 and the right brim joint 17, as can be seen in FIG. 9 and FIG. 10. The hook part 15 of the left brim joint 12 is attached to the left loop strip 20; the hook part 15 of the right brim joint 17 is attached to the right loop strip 21; the loop part 16 of the left brim joint 12 is attached to the left hook strip 18; and, the loop part 16 of the right brim joint 17 being attached to the right hook strip 19. By opening the left brim joint 12 and the right brim joint 17, the left headset hole 10 and the right headset hole 11 are now open and ready to receive the headset 22. Then the user places the full-brimmed hat 1 over the top of his or head and respectively aligns the left headset hole 10 and the right headset hole 11 with his or her left and right ears. With the headset 22 being placed over the circular bucket 2, the user can then close the left brim joint 12 and the right brim joint 17. More specifically, the hook part 15 of the left brim joint 12 is attached back into the loop part 16 of the left brim joint 12, and the hook part 15 of the right brim joint 17 is attached back into the loop part 16 of the right brim joint 17. The user can also adjust the size of the left headset hole 10 and the right headset hole 11 to better suit the size of the left earpiece 24 and the right earpiece 25 by altering the positioning of the hook part 15 to the loop part 16 of the left brim joint 12 and the right brim joint 17.

In the system for the present invention, the headset 22 comprises a frame 23, a left earpiece 24, and a right earpiece 25, which can be seen in FIGS. 1 and 2. The left earpiece 24 and the right earpiece 25 are connected by the frame 23, and the frame 23 is adjacently positioned atop of the circular bucket 2. The headset 22 may optionally comprise a microphone if the headset functions as a two way communication device. The left earpiece 24 is positioned within the left headset hole 10 and the right earpiece 25 is positioned within the right headset hole 11. More specifically, the full-brimmed hat 1 is able to contain a full sized headset 22 as the left earpiece 24 and the right earpiece 25 are placed within the left headset hole 10 and the right headset hole 11. The present invention is intended to be used with the headset 22, however, other varieties of headgear such as, but not limited to, earmuffs, hearing protectors, and a pair of headphones, may be worn.

Figure 11:
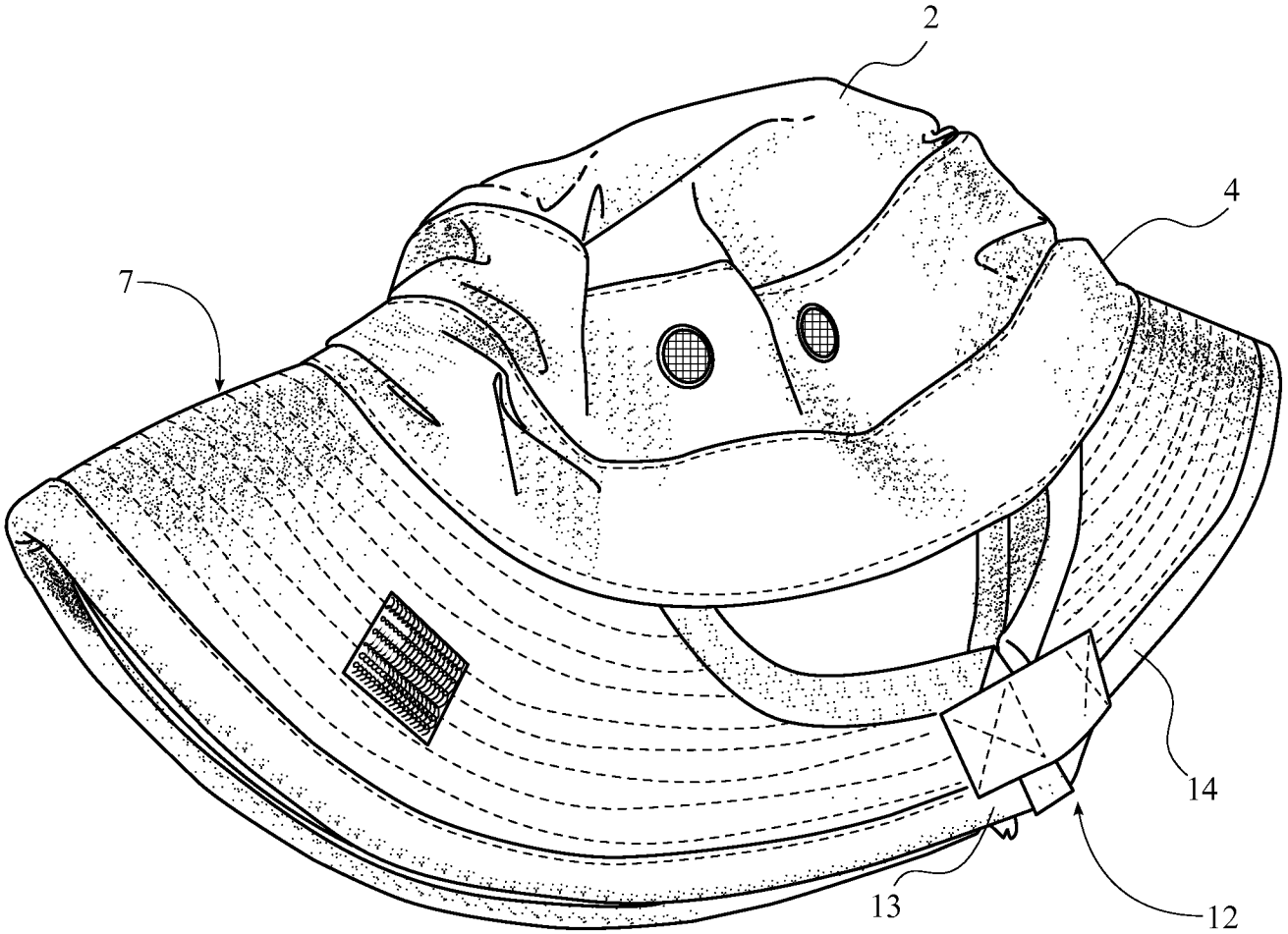
FIG. 11 is a perspective view of the present invention folded in half.
Figure 12:
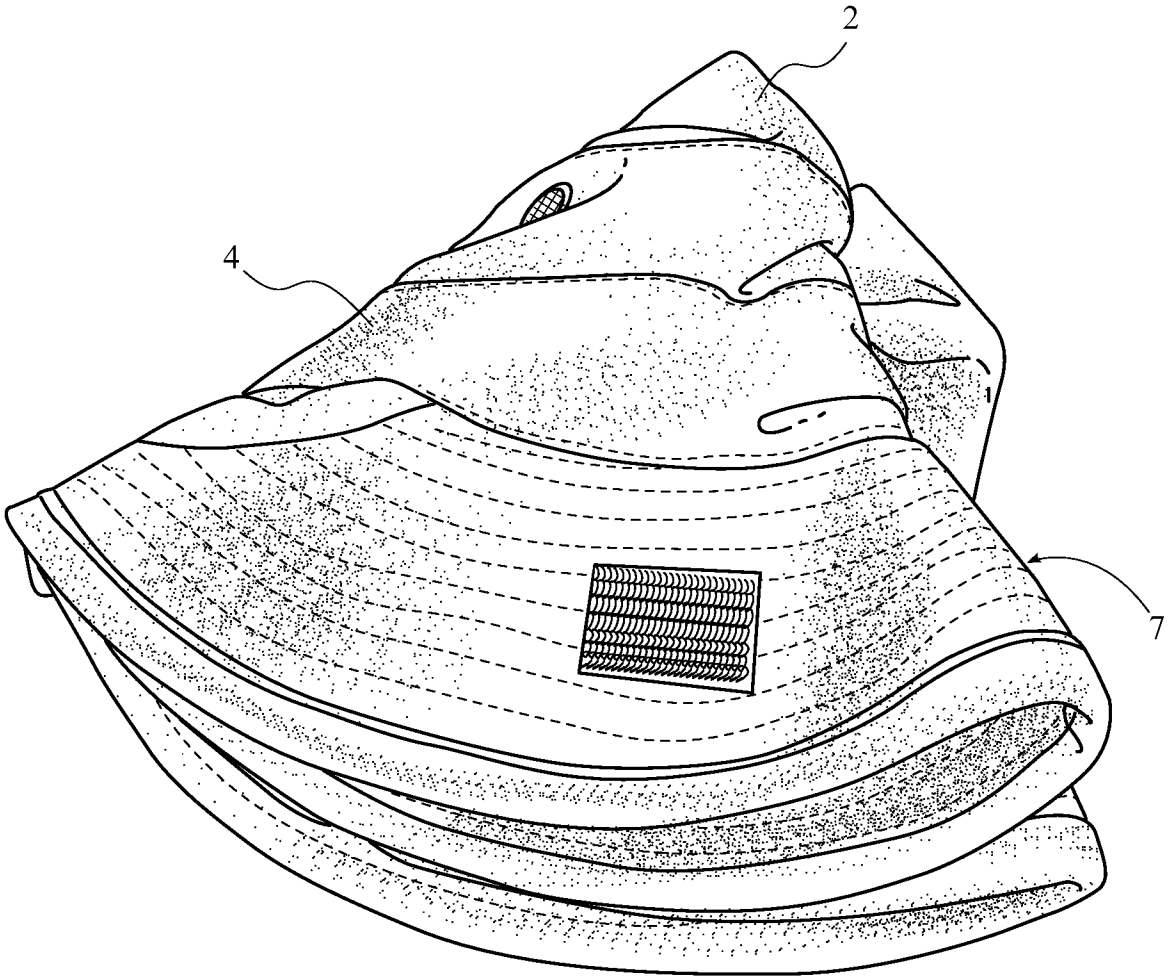
FIG. 12 is a perspective view of the present invention in its storage mode.

The present invention may also be stored in a space efficient form, which can be seen in FIG. 12. The user folds the present invention in half so that the left brim joint 12 and the right brim joint 17 meet and align with each other, as shown in FIG. 11. The user then takes the present invention and folds it in half once more, in the direction so that either the left hook strip 18 interlocks with the left loop strip 20, or the other direction, so that the right hook strip 19 interlocks with the right loop strip 21. This position, as seen in FIG. 12, allows the user to store the present invention in a space efficient form so that the present invention does not take up unnecessary room and is more easily stowable in a pocket or backpack. The left hook strip 18, the right hook strip 19, the left loop strip 20, and the right loop strip 21 allow the present invention to stay in this folded position.

A first alternative embodiment for the present invention may feature a smaller left headset hole 10 and a smaller right headset hole 11 for a smaller headset 22. Alternatively, the user may simply thread the left earpiece 24 and the right earpiece 25 through the left headset hole 10 and the right headset hole 11 respectively without opening the left brim joint 12 and the right brim joint 17. A second alternative embodiment of the present invention, the left brim joint 12 and the right brim joint 17 respectively opens away from the center of the left headset hole 10 and the right headset hole 11, where the left brim joint 12 and the right brim joint 17 are positioned either toward the front end of the left headset hole 10 and the right headset hole 11 or the back end of the left headset hole 10 and the right headset hole 11. A third alternative embodiment of the present invention, the full-brimmed hat 1 comprises either the left headset hole 10 and the left brim joint 12 or the right headset hole 11 and the right brim joint 17 in such way that the third alternative embodiment only accommodates a headset 22 with only one earpiece. A fourth alternative embodiment of the present invention features no brim joints adjacent to the left headset hole 10 and the right headset hole 11.

The preferred embodiment of the present invention uses a hook and loop fastening mechanism for both the left brim joint 12 and the right brim joint 17. However, alternative fastening mechanisms may be used such as, but not limited to, a ball and socket snap fastener, button fasteners, magnetic fasteners or some other simple fastening mechanisms commonly used with fabric.

Although the invention has been explained in relation to its preferred embodiment, it is to be understood that many other possible modifications and variations can be made without departing from the spirit and scope of the invention as hereinafter claimed.

What is claimed is:

1. A system for a full-brimmed hat capable of accommodating a headset comprises:

a full-brimmed hat;

the full-brimmed hat comprises a circular bucket, and a full-brim;

the full-brim comprises an inner diameter, an outer diameter, a left headset hole, a right headset hole, a left brim joint, a right brim joint, a left fastening mechanism, a right fastening mechanism and a right and left brim joint inner edge;

the left brim joint and the right brim joint each comprise a first flap, a second flap;

the right brim joint being positioned between the right headset hole and the outer diameter; and the left brim joint being positioned between the left headset hole and the outer diameter; wherein the right and left brim joint is a slit extending between the brim joint inner edge and the full-brim outer diameter allowing two brim ends along the slit to be separable and attachable via the first and second flaps.

2. The system for a full-brimmed hat capable of accommodating a headset as claimed in claim 1 comprises:

the left headset hole and the right headset hole being diametrically opposed to each other around the full-brim;

the left headset hole and the right headset hole traversing through the full-brim; and the left headset hole and the right headset hole being adjacently positioned around the inner diameter.

3. The system for a full-brimmed hat capable of accommodating a headset as claimed in claim 1 comprises:

the first flap being adjustably attached to the second flap through the fastening mechanisms.

4. The system for a full-brimmed hat capable of accommodating a headset as claimed in claim 1 comprises:

the fastening mechanisms being radially positioned around the full-brim.

5. The system for a full-brimmed hat capable of accommodating a headset as claimed in claim 1 comprises:

a headset;

the headset comprises a frame, a left earpiece, and a right earpiece;

the left earpiece and the right earpiece being connected by the frame;

the frame being adjacently positioned atop of the circular bucket;

the left earpiece being positioned within the left headset hole; and the right earpiece being positioned within the right headset hole.

6. A system for a full-brimmed hat capable of accommodating a headset comprises:

a full-brimmed hat;

the full-brimmed hat comprises a circular bucket, a rim, and a full-brim;

the full-brim comprises an inner diameter, an outer diameter, a left headset hole, a right headset hole, a left brim joint, a right brim joint, a left fastening mechanism, a right fastening mechanism and a right and left brim joint inner edge;

the left brim joint and the right brim joint each comprise a first flap, a second flap;

the left headset hole and the right headset hole being diametrically opposed to each other around the full-brim;

the left headset hole and the right headset hole traversing through the full- brim; and the left headset hole and the right headset hole being adjacently positioned around the inner diameter;

wherein the right and left brim joint is a slit extending between the brim joint inner edge and the full-brim outer diameter allowing two brim ends along the slit to be separable and attachable via the first and second flaps;

a headset;

the headset comprises a frame, a left earpiece, and a right earpiece; the left earpiece and the right earpiece being connected by the frame; the frame being adjacently positioned atop of the circular bucket; the left earpiece being positioned within the left headset hole; the right earpiece being positioned within the right headset hole.

7. The system for a full-brimmed hat capable of accommodating a headset as claimed in claim 6 comprises:

the left brim joint being positioned between the left headset hole and the outer diameter;

and the first flap being adjustably attached to the second flap through the fastening mechanisms.

8. The system for a full-brimmed hat capable of accommodating a headset as claimed in claim 6 comprises:

the right brim joint being positioned between the right headset hole and the outer diameter;

and the first flap being adjustably attached to the second flap through the fastening mechanisms.

9. The system for a full-brimmed hat capable of accommodating a headset as claimed in claim 6 comprises:

the fastening mechanisms being radially positioned around the full-brim.

10. A system for a full-brimmed hat capable of accommodating a headset comprises:

a full-brimmed hat;

the full-brimmed hat comprises a circular bucket, and a full-brim;

the full-brim comprises an inner diameter, an outer diameter, a left headset hole, a right headset hole, a left brim joint, a right brim joint, a left fastening mechanism a right fastening mechanism and a right and left brim joint inner edge;

the left brim joint and the right brim joint each comprise a first flap, a second flap;

the left headset hole and the right headset hole being diametrically opposed to each other around the full-brim;

the left headset hole and the right headset hole traversing through the full-brim;

the left headset hole and the right headset hole being adjacently positioned around the inner diameter;

the left brim joint being positioned between the left headset hole and the outer diameter; and the first flap being adjustably attached to the second flap through the fastening mechanisms; wherein the right and left brim joint is a slit extending between the brim joint inner edge and the full-brim outer diameter allowing two brim ends along the slit to be separable and attachable via the first and second flaps.

11. The system for a full-brimmed hat capable of accommodating a headset as claimed in claim 10 comprises:

the right brim joint being positioned between the right headset hole and the outer diameter;

and the first flap being adjustably attached to the second flap through the fastening mechanism.

12. The system for a full-brimmed hat capable of accommodating a headset as claimed in claim 10 comprises:

the fastening mechanisms being radially positioned around the full-brim.

13. The system for a full-brimmed hat capable of accommodating a headset as claimed in claim 10 comprises:

a headset;

the headset comprises a frame, a left earpiece, and a right earpiece;

the left earpiece and the right earpiece being connected by the frame;

the frame being adjacently positioned atop of the circular bucket;

the left earpiece being positioned within the left headset hole; and the right earpiece being positioned within the right headset hole.

* * * * *